US011189947B2

(12) United States Patent
Schrader et al.

(10) Patent No.: US 11,189,947 B2
(45) Date of Patent: Nov. 30, 2021

(54) SOCKET SOLDERING CONTACT AND CONTACT MODULE FOR A PRINTED CIRCUIT BOARD

(71) Applicant: PHOENIX CONTACT GMBH & CO. KG, Blomberg (DE)

(72) Inventors: Andreas Schrader, Delbrueck (DE); Ingo Werner, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/762,636

(22) PCT Filed: Nov. 8, 2018

(86) PCT No.: PCT/EP2018/080567
§ 371 (c)(1),
(2) Date: May 8, 2020

(87) PCT Pub. No.: WO2019/092080
PCT Pub. Date: May 16, 2019

(65) Prior Publication Data

US 2020/0280146 A1 Sep. 3, 2020

(30) Foreign Application Priority Data

Nov. 10, 2017 (BE) ..... 2017/5814

(51) Int. Cl.
*H01R 12/00* (2006.01)
*H01R 13/11* (2006.01)
(Continued)

(52) U.S. Cl.
CPC ..... *H01R 13/112* (2013.01); *H01R 12/7088* (2013.01); *H01R 12/718* (2013.01);
(Continued)

(58) Field of Classification Search
CPC ..... H01R 13/112; H01R 12/7088; H01R 12/718; H01R 12/724; H01R 13/17; H01R 13/4361
(Continued)

(56) References Cited

U.S. PATENT DOCUMENTS 5,004,426 A 4/1991 Barnett
5,052,953 A 10/1991 Weber
(Continued)

FOREIGN PATENT DOCUMENTS

DE 1046137 12/1958
DE 10310899 5/2004
WO 2004/047233 6/2004

OTHER PUBLICATIONS

English translation of International Preliminary Report on Patentability from corresponding PCT Appln. No. PCT/EP2018/080567, dated May 12, 2020.
(Continued)

*Primary Examiner* — Abdullah A Riyami
*Assistant Examiner* — Nelson R. Burgos-Guntin
(74) *Attorney, Agent, or Firm* — Grossman, Tucker, Perreault & Pfleger, PLLC

(57) ABSTRACT

A solder socket contact for a printed circuit board, comprising a first contact element and a second contact element, wherein the first contact element has at least one soldering pin which is designed to be soldered to the printed circuit board, the first contact element has a contact region for contacting a plug contact, the second contact element has at least one soldering pin which is designed to be soldered to the printed circuit board, the second contact element has a contact region for contacting the plug contact, and the first contact element and the second contact element form an individual pole for contacting the plug contact.

9 Claims, 2 Drawing Sheets

(51) Int. Cl.

| | |
|---|---|
| ***H01R 12/70*** | (2011.01) |
| ***H01R 12/71*** | (2011.01) |
| ***H01R 12/72*** | (2011.01) |
| ***H01R 13/17*** | (2006.01) |
| ***H01R 13/436*** | (2006.01) |

(52) U.S. Cl.
CPC ..... *H01R 12/724* (2013.01); *H01R 13/17* (2013.01); *H01R 13/4361* (2013.01)

(58) Field of Classification Search
USPC ..... 439/81
See application file for complete search history.

(56) References Cited

U.S. PATENT DOCUMENTS 5,733,136 A * 3/1998 Kajiwara ..... H05K 7/1069 439/259
6,921,301 B2 7/2005 Conrad
7,824,197 B1 * 11/2010 Westman ..... H01R 13/6471 439/108
8,979,572 B2 * 3/2015 Mochizuki ..... F21V 21/002 439/417
9,627,818 B1 * 4/2017 Chen ..... H01R 12/707
9,735,526 B1 8/2017 Chen
2005/0101162 A1 5/2005 Henneberg
2009/0142953 A1 6/2009 Patel et al.
2016/0006192 A1 * 1/2016 Leibold ..... H01R 13/113 439/660
2016/0172771 A1 * 6/2016 Lappoehn ..... H01R 12/515 439/443
2016/0211630 A1 * 7/2016 Kizhakkamparambill Paul ..... H01R 24/62
2020/0350717 A1 * 11/2020 Dong ..... H01R 13/112

OTHER PUBLICATIONS

English translation of International Search Report from corresponding PCT Appln No. PCT/EP2018/080567, dated Dec. 6, 2018.

* cited by examiner

SOCKET SOLDERING CONTACT AND CONTACT MODULE FOR A PRINTED CIRCUIT BOARD

FIELD

The present invention relates to a socket soldering contact for a printed circuit board and a contact module for a printed circuit board having such a socket soldering contact.

BACKGROUND

Contact modules that are soldered to a printed circuit board, such as contact sockets or base strips, usually have a socket soldering contact for each pole, which consists of a single solder metal. The geometry of this solder metal specifies the position of a plug contact, the arrangement of the soldering contacts and the mounting force required for inserting a plug into a contact area of the solder metal. In this case, it is disadvantageous that such a socket soldering contact is not variable with respect to the aforementioned position of the plug contact, the arrangement of the solder contacts, as well as the required mounting force.

Against this background, the invention is based on the technical problem of specifying a socket soldering contact and a contact module for a printed circuit board, which do not have the preceding disadvantages or have the latter at least in a smaller range, and in particular allow a reliable, variable contact of plug contacts and an easier assembly of plugs to be inserted.

SUMMARY

According to a first aspect, the invention relates to a socket soldering contact for a printed circuit board, having a first contact element and having a second contact element, wherein the first contact element has at least one soldering pin, which is designed for soldering with the printed circuit board, wherein the first contact element has a contact area for contacting a plug contact, wherein the second contact element has at least one soldering pin, which is designed for soldering to the printed circuit board, and wherein the second contact element has a contact area for contacting the plug contact and wherein the first contact element and the second contact element form a single pole for contacting the plug contact.

Due to the at least two-part structure of the socket soldering contact, two contact areas can be specified, which allow contacting of a plug contact. The contacting of a plug contact is therefore more variable and not limited to a single contact area, as it is for example for the case of the socket soldering contact consisting of a one-piece soldering metal.

According to a further embodiment of the socket soldering contact, it is provided that the contact area of the first contact element has a local narrowing for the form-locking and/or force-locking reception of the plug contact, wherein the contact area of the second contact element has a local narrowing for the form-locking and/or force-locking reception of the plug contact and wherein the local narrowing of the first contact element, viewed along an insertion direction of the plug contact, has a local offset relative to the local narrowing of the second contact element.

By the offset of the narrowing of the contact area of the first contact element compared to the narrowing of the second contact element, the mechanical resistance of the socket soldering contact against an inserting of a plug can be reduced in that the plug to be introduced, viewed along the insertion direction, first passes along a further narrowing and then hits the further narrowing.

According to a further embodiment of the socket soldering contact, it is provided that the contact area of the first contact element has at least two free projecting webs, wherein the local narrowing of the first contact element has at least one contact nib provided at a web and wherein the contact nib at least in sections extends in the direction of the other web and wherein the contact area of the second contact element has at least two free-projecting webs, wherein the local narrowing of the second contact element has at least one contact nib provided at a web and wherein the contact nib extends at least in sections in the direction of the other web, and wherein the contact nib of the first contact element, viewed along an insertion direction of the plug contact, has an offset relative to the contact nib of the second contact element.

The contact nibs can cause a defined contact of a plug contact. Since the contact nibs are arranged offset along the insertion direction relative to each other, a plug contact of a plug can abut in the finished mounted condition on the contact nib of the first contact element and/or on the contact nib of the second contact element.

The projecting webs can be formed as spring arms, which are designed to abut an associated plug contact being clamped in a spring-elastic manner Such a spring arm can be deflected by inserting a plug on an upper surface of the plug sliding transversely to the insertion direction of the plug or the plug contact and thus be clamped against the plug contact in a spring-elastic manner. In this way, a simple, reliable and damage-free detachable contact can be achieved between a plug contact and the socket soldering contact.

It may be provided that the local narrowing of the first contact element has two contact nibs facing each other, which are formed at the webs of the first contact element. Alternatively or additionally, it may be provided that the local narrowing of the second contact element has two contact nibs facing each other, which are formed at the webs of the second contact element. Thus, a two-sided contact of a plug contact can be effected.

According to a further embodiment of the socket soldering contact, it is provided that the local narrowing of the first contact element is provided at the end in the area of the free web ends of the webs of the first contact element. Alternatively or additionally, it may be provided that the local narrowing of the second contact element is provided at the end in the area of the free web ends of the webs of the second contact element. In this way, a compact design and a reliable contact of a plug contact can be achieved.

According to a further embodiment of the socket soldering contact, it is provided that at least one of the webs has a resting protrusion for locking in a plastics material housing of a contact module, wherein the resting protrusion is arranged in particular on a side of the web facing away from the contact nib. A resting protrusion may be designed to engage from behind into a recess, a protrusion, or a back cut of the plastics material housing of the contact module, or to abut a stop formed on the plastics material housing, in order to secure the plastics material housing of the contact module in a form-locking and/or force-locking manner against pulling or losing in the opposite direction to the insertion direction.

According to a further embodiment of the socket soldering contact, it is provided that the soldering pin of the first contact element has a crank in the direction of the second contact element, that the soldering pin of the second contact element has a crank in the direction of the first contact element, and that from the respective crank, projecting free ends of the soldering pins are lined up in an aligned, comb-like manner, when viewed along an insertion direction of the plug contact. In this way, a compact design of the socket soldering contact can be achieved.

It may be provided that the first contact element has at least two soldering pins, in particular exactly two soldering pins, that the second contact element has at least two soldering pins, in particular exactly two soldering pins, wherein at least one soldering pin of the first contact element, in particular exactly one soldering pin of the first contact element, is arranged between two soldering pins of the second contact element and wherein at least one soldering pin of the second contact element, in particular exactly one soldering pin of the second contact element, is arranged between two soldering pins of the first contact element. Thus, a compact design of the socket soldering contact can be achieved by choosing a very narrow distance between the comb-like interconnected soldering pins with the same current capacity and in particular is not predetermined by punch-technically caused minimum distances.

According to a further embodiment of the socket soldering contact, it is provided that the first contact element and the second contact element at least partially abut each other in a gap-free manner. In this way, a compact design of the socket soldering contact can be achieved.

Alternatively or additionally, it may be provided that the first contact element and the second contact element are interconnected at least partially in a material-locking and/or adhesive and/or form-locking, and/or force-locking manner. This allows a reliable abutment of the first contact element and the second contact element to be achieved.

According to a second aspect, the invention relates to a contact module for a printed circuit board, having a plastics material housing, having at least one receiving opening for inserting a plug, and having at least one socket soldering contact associated to the receiving opening and received in the plastics material housing, wherein the socket soldering contact is formed according to the invention.

The at least two-part structure of the socket soldering contact serves to contact a single pole of a plug contact. In the fully assembled state of a plug, a separate two-part socket soldering contact is therefore assigned to each pole of the plug. A contact module can therefore have a plurality of two-part socket soldering contacts, each assigned to a pole.

The contact module can be a base strip or a contact socket, each of which is designed for soldering to a printed circuit board.

Insofar as soldering pins are cranked in the manner described above, the required standard distances of adjacent poles can be complied with on a confined construction space.

BRIEF DESCRIPTION OF THE DRAWINGS

In the following, the invention is described more closely on the basis of an embodiment of the present drawings. In the drawings.

DETAILED DESCRIPTION

Figure 1:
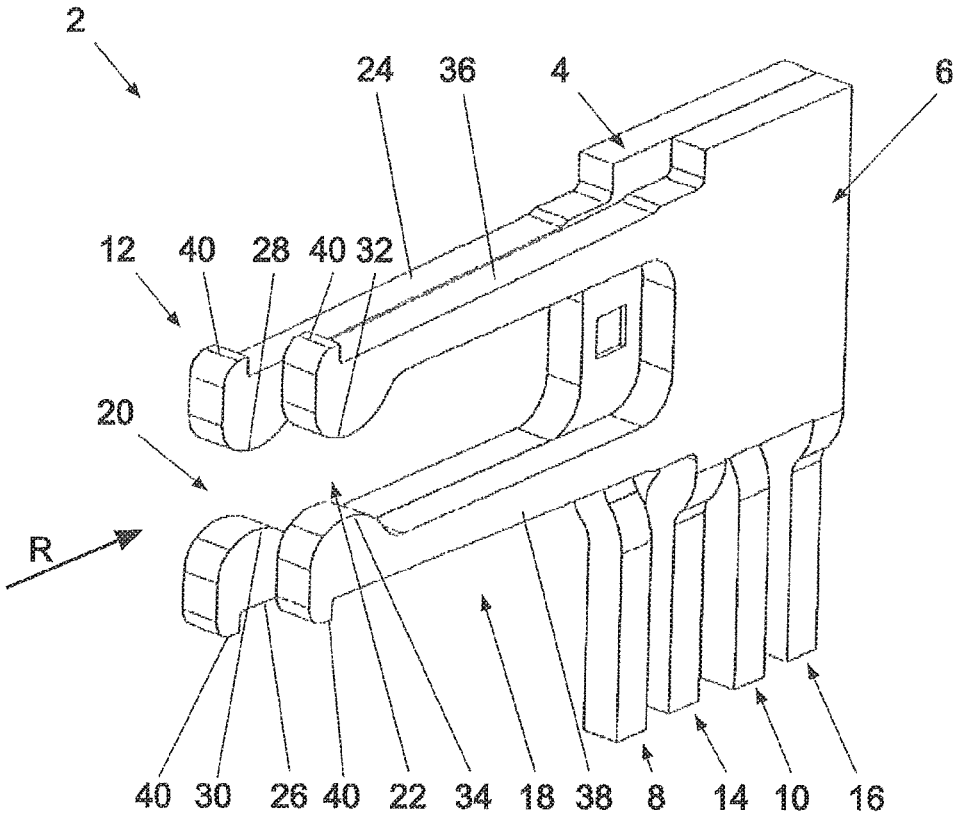
FIG. 1 shows a socket soldering contact according to the invention in a perspective view from above.

FIG. 1 shows a socket soldering contact 2 for a printed circuit board. The socket soldering contact 2 has a first contact element 4 and a second contact element 6.

The position of the first contact element 4 shown in FIG. 1 relative to the second contact element 6 describes the socket soldering contact 2 in the finished mounted state, soldered on a printed circuit board. In the finished mounted state shown in FIG. 1 of the socket soldering contact 2, the first contact element 4 and the second contact element 6 abut each other in a gap-free manner.

Figure 2:
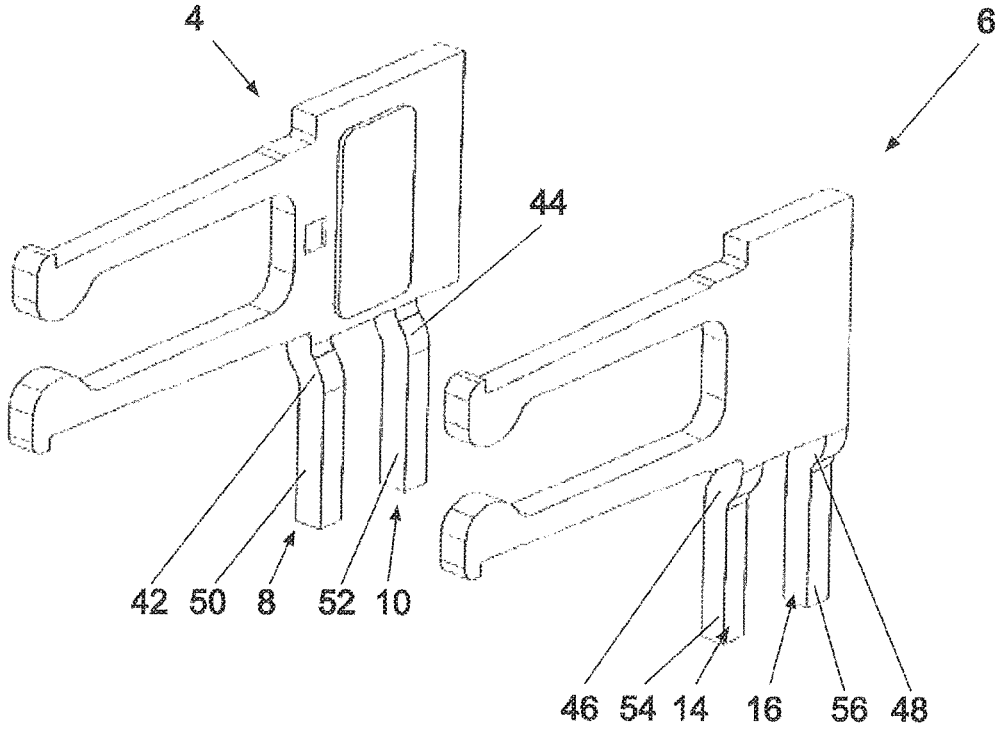
FIG. 2 shows contact elements of the socket soldering contact from FIG. 1 in a perspective view from above.

FIG. 2 shows the contact element 4 and the contact element 6 each separately in individual representations to clarify the structural embodiment of the contact elements 4, 6 forming the socket soldering contact 2.

The first contact element 4 has a first soldering pin 8 and a second soldering pin 10. The soldering pins 8, 10 of the first contact element 4 are designed for soldering with a printed circuit board.

The first contact element 4 has a contact area 12 for contacting a plug contact.

The second contact element 6 has a first soldering pin 14 and a second soldering pin 16. The first soldering pin 14 and the second soldering pin 16 of the second contact element 6 are designed for soldering with a printed circuit board.

The second contact element 6 has a contact area 18 for contacting a plug contact.

The first contact element 4 and the second contact element 6 form a single pole for contacting the plug contact.

The contact area 12 of the first contact element 4 has a local narrowing 20. The local narrowing 20 of the first contact element 4 is provided for the form-locking and/or force-locking reception of the plug contact. The contact area 18 of the second contact element 6 has a local narrowing 22. The local narrowing 22 of the second contact element 6 is provided for the form-locking and/or force-locking reception of the plug contact. The local narrowing 20 and the local narrowing 22 are arranged offset to each other along an insertion direction R of the plug contact.

The contact area 12 of the first contact element 4 has two free-projecting webs 24, 26. The local narrowing 20 of the first contact area 12 is formed in the present case by two contact nibs 28, 30. Here, the contact nib 28 extends in the direction of the web 26. The contact nib 30 extends in the direction of the web 24.

The local narrowing 22 of the contact area 18 of the second contact element 6 is formed by contact nibs 32, 34 facing each other, which are provided at projecting webs 36, 38 of the contact area 18 of the second contact element.

The contact nibs 28, 30 of the first contact element and the contact nibs 32, 34 of the second contact element 6 are arranged, viewed along the insertion direction R, offset to each other.

Figure 3A:
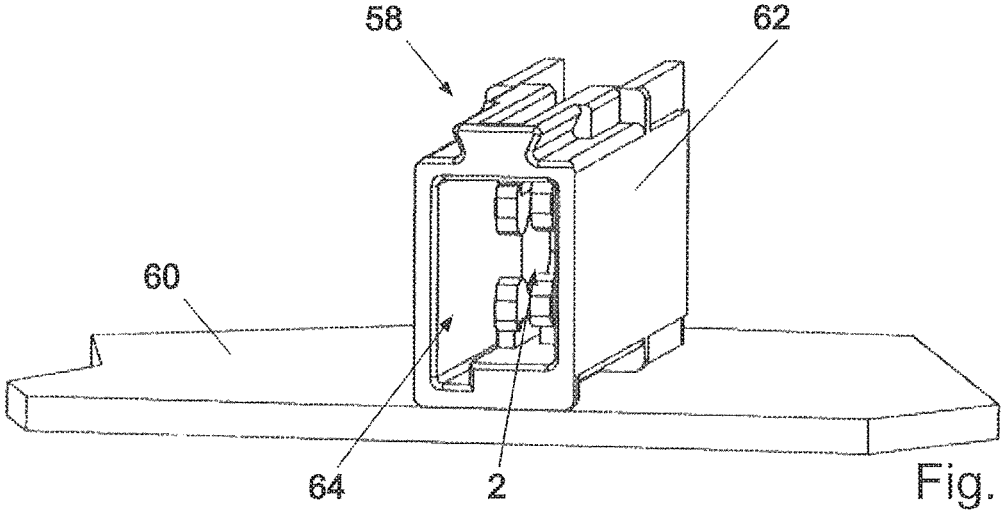
FIG. 3A shows a contact module according to the invention with the socket soldering contact from FIG. 1 in a first perspective view.

The local narrowing 20 or the contact nibs 28, 30 are arranged at the end in the area of the free web ends of the webs 24, 26. Similarly, the local narrowing 22, which is formed by the contact nibs 32, 34, is provided at the end in the area of the free web ends of the webs 36, 38. At each web 24, 26, 36, 38, a resting protrusion 40 is provided for locking a plastics material housing 62 of a contact module 58 (FIG. 3A).

Each resting protrusion 40 is arranged on a side facing away from the respective contact nib 28, 30, 32, 34 of the respective free web end of the assigned web 24, 26, 36, 38.

The soldering pins 8, 10 of the first contact element 4 each have a crank 42, 44 in the direction of the second contact element 6. The soldering pins 14, 16 of the second contact element each have a crank 46, 48 in the direction of the first contact element 4. From the respective crank 42, 44, 46, 48, projecting, free ends 50, 52, 54, 56 of the soldering pins 8, 10, 14, 16 are lined up in an aligned, comb-like manner along the insertion direction R of the plug contact.

The soldering pin 10 of the first contact element 4 is arranged between the soldering pins 14, 16 of the second contact element 6. The soldering pin 14 of the second contact element 6 is arranged between the soldering pins 8, 10 of the first contact element 4.

Figure 3B:
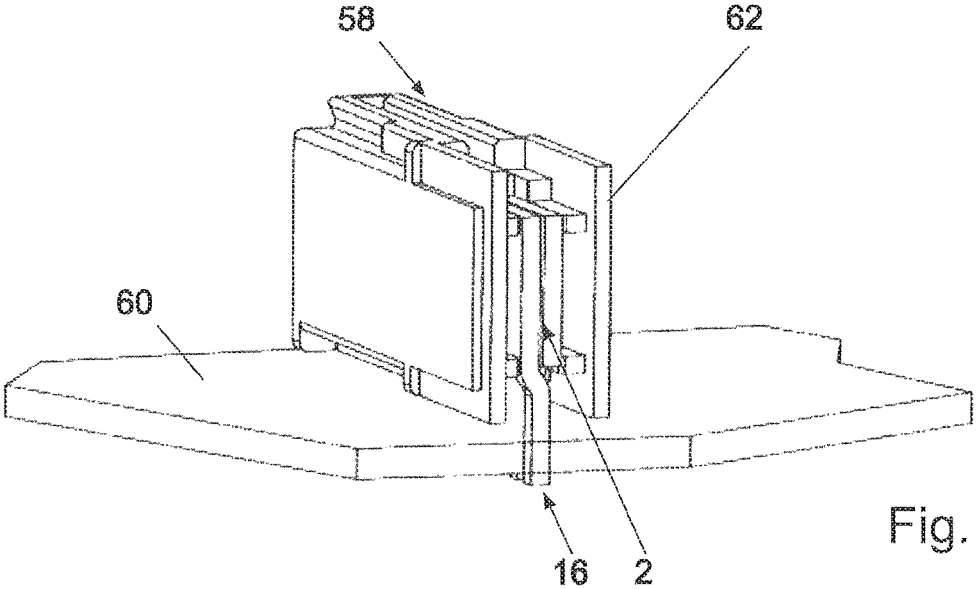
FIG. 3B shows the contact module of FIG. 3A in a second perspective view.
Figure 3C:
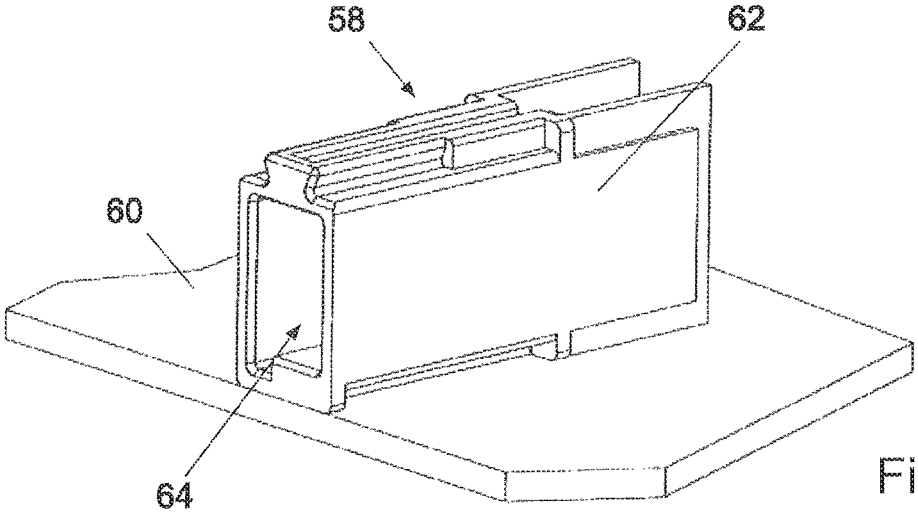
FIG. 3C shows the contact module of FIG. 3A in a third perspective view.

FIGS. 3A, 3B, and 3C show a contact module 58 according to the invention for a printed circuit board 60. The contact module 58 has a plastics material housing 62, having at least one receiving opening 64 for inserting a plug. The contact module 58 has at least one socket soldering contact 2 assigned to the receiving opening 64 and received in the plastics material housing 62, wherein the socket soldering contact 2 is formed according to the FIGS. 1 and 2 in a manner according to the invention.

REFERENCE NUMERALS

2 socket soldering contact
4 first contact element
6 second contact element
8 soldering pin
10 soldering pin
12 contact area
14 soldering pin
16 soldering pin
18 contact area
20 local narrowing
22 local narrowing
24 web
26 web
28 contact nib
30 contact nib
32 contact nib
34 contact nib
36 contact nib
38 contact nib
40 resting protrusion
42 crank
44 crank
46 crank
48 crank
50 free end
52 free end
54 free end
56 free end
58 contact module
60 printed circuit board
62 plastics material housing
64 receiving opening

What is claimed is:

1. A socket soldering contact for a printed circuit board, comprising:

a first contact element; and a second contact element, wherein:

the first contact element has at least one soldering pin which is designed for soldering with the printed circuit board;

the first contact element has a contact area for contacting a plug contact;

the second contact element has at least one soldering pin for soldering with the printed circuit board;

the second contact element has a contact area for contacting the plug contact;

the first contact element and the second contact element form a single pole for contacting the plug contact;

the first contact element has at least two soldering pins;

the second contact element has at least two soldering pins;

at least one soldering pin of the first contact element is arranged between two soldering pins of the second contact element; and at least one soldering pin of the second contact element is arranged between two soldering pins of the first contact element.

2. The socket soldering contact according to claim 1, wherein:

the contact area of the first contact element has a local narrowing for the form-locking and/or force-locking insertion of the plug contact;

the contact area of the second contact element has a local narrowing for the form-locking and/or force-locking insertion of the plug contact; and the local narrowing of the first contact element is offset along an insertion direction of the plug contact relative to the local narrowing of the second contact element.

3. The socket soldering contact according to claim 2, wherein:

the contact area of the first contact element has at least two free-projecting webs, wherein the local narrowing of the first contact element has at least one contact nib provided at a web and wherein the contact nib is at least partially extended in the direction of the other web;

the contact area of the second contact element has at least two free-projecting webs, wherein the local narrowing of the second contact element has at least one contact nib provided at a web and wherein the contact nib is stretched at least in sections in the direction of the other web; and the contact nib of the first contact element along an insertion direction of the plug contact is offset relative to the contact nib of the second contact element.

4. The socket soldering contact according to claim 3, wherein:

the local narrowing of the first contact element has two contact nibs facing each other, which are formed at the webs of the first contact element; and/or the local narrowing of the second contact element has two mutually facing contact nibs formed at the webs of the second contact element.

5. The socket soldering contact according to claim 3, wherein:

the local narrowing of the first contact element is provided at the end in the area of the free web ends of the webs of the first contact element; and/or the local narrowing of the second contact element is provided at the end in the area of the free web ends of the webs of the second contact element.

6. The socket soldering contact according to claim 3, wherein at least one of the webs has a resting protrusion for locking in a plastics material housing of a contact module, wherein the resting protrusion is arranged on a side of the web facing away from the contact nib.

7. The socket soldering contact according to claim 1, wherein:

the soldering pin of the first contact element has a crank in the direction of the second contact element;

the soldering pin of the second contact element has a crank in the direction of the first contact element; and from the respective crank, projecting, free ends of the soldering pins are lined up in an aligned, comb-like manner along an insertion direction of the plug contact.

8. The socket soldering contact according to claim 1, wherein:

the first contact element and the second contact element abut each other at least partially in a gap-free manner; and/or the first contact element and the second contact element are at least partially interconnected in a material-locking and/or adhesive and/or form-locking, and/or force-locking manner.

9. A contact module for a printed circuit board, comprising:

a plastics material housing;

at least one receiving opening for inserting a plug;

at least one socket soldering contact assigned to the receiving opening and received in the plastic housing, wherein the socket soldering contact is formed according to claim 1.

* * * * *